US009957657B2

(12) United States Patent
Dirnberger et al.

(10) Patent No.: US 9,957,657 B2
(45) Date of Patent: May 1, 2018

(54) APPLIANCE LOCK

(71) Applicant: emz-Hanauer GmbH & Co. KGaA, Nabburg (DE)

(72) Inventors: Albert Otto Dirnberger, Neunburg v. W. (DE); Markus Michael Lang, Neunburg v. W. (DE)

(73) Assignee: EMZ-HANAUER GMBH & CO. KGAA, Nabburg (DE)

( * ) Notice: Subject to any disclaimer, the term of this patent is extended or adjusted under 35 U.S.C. 154(b) by 457 days.

(21) Appl. No.: 14/609,715

(22) Filed: Jan. 30, 2015

(65) Prior Publication Data

US 2016/0222573 A1 Aug. 4, 2016

(51) Int. Cl.

| | |
|---|---|
| ***E05C 1/08*** | (2006.01) |
| ***D06F 37/42*** | (2006.01) |
| ***D06F 37/28*** | (2006.01) |
| *E05C 1/00* | (2006.01) |

(52) U.S. Cl.
CPC ..... *D06F 37/42* (2013.01); *D06F 37/28* (2013.01); *Y10S 292/69* (2013.01)

(58) Field of Classification Search
CPC ..... Y10S 292/69; D06F 37/28; D06F 37/42
USPC ..... 292/156, 157, 163, 164, 341.15
See application file for complete search history.

(56) References Cited

U.S. PATENT DOCUMENTS 3,638,457 A * 2/1972 Filipak ..... D06F 37/42 68/12.26
4,764,648 A * 8/1988 Resh ..... H01H 3/163 200/50.1
5,062,668 A 11/1991 Onderka et al.
5,520,424 A 5/1996 Hapke et al.
5,524,944 A * 6/1996 Berg ..... E05B 67/383 292/148
5,704,661 A * 1/1998 Takimoto ..... E05B 65/0864 292/162

(Continued)

FOREIGN PATENT DOCUMENTS

CN 1570253 A 1/2005
CN 1824879 A 8/2006

(Continued)

OTHER PUBLICATIONS

Corresponding Chinese Application No. 201610066752.7, Chinese Office action dated Sep. 4, 2017.

*Primary Examiner* — Carlos Lugo
(74) *Attorney, Agent, or Firm* — Cooper Legal Group LLC; Ronald Kachmarik

(57) ABSTRACT

An appliance lock includes a housing and a lid movable between an open and closed positions. First and second sliders supported for movement by the housing. A striker is attachable to the other of the appliance body and lid. The striker is connectable with the housing upon movement of the lid to the closed position. The striker has a first portion for engaging and moving the first slider from a first position to a second position upon lid movement to the closed position. The striker has a second portion for engaging and moving the second slider from a first position to a second position upon lid movement to the closed position. The first and second sliders being in the second positions enables activation of the appliance. Structure minimizes the ability to move the first and second sliders to the second position by substantially anything but the striker.

20 Claims, 17 Drawing Sheets

(56) References Cited

U.S. PATENT DOCUMENTS 5,823,017 A * 10/1998 Hapke ..... D06F 37/42 210/146
6,082,787 A * 7/2000 Chioffi ..... D06F 37/42 292/128
6,145,898 A * 11/2000 Onderka ..... D06F 37/42 292/198
7,251,961 B2 8/2007 Hapke et al.
7,410,194 B2 * 8/2008 Chen ..... E05C 1/14 292/37
7,600,794 B2 * 10/2009 Ramsauer ..... E05C 1/16 292/163
7,690,700 B2 4/2010 Neumann
7,705,253 B2 4/2010 Krieger et al.
8,016,328 B2 * 9/2011 Sans Rovira ..... D06F 37/42 292/116
8,123,312 B2 * 2/2012 Jeon ..... D06F 37/42 292/121
8,152,207 B2 * 4/2012 Hartmann ..... A47L 15/4259 292/335
8,193,461 B2 6/2012 Spiessl
8,246,089 B2 * 8/2012 Mueller ..... A47L 15/4259 292/24
8,272,169 B2 * 9/2012 Mandi ..... E05B 15/02 292/137
8,276,951 B2 10/2012 Dirnberger et al.
8,449,006 B2 * 5/2013 Joerger ..... D06F 37/28 292/340
8,648,321 B2 2/2014 Schenkel et al.
8,702,134 B2 * 4/2014 Lesjak ..... E05B 63/128 292/340
8,736,406 B2 5/2014 Hapke et al.
9,487,907 B2 * 11/2016 Hapke ..... D06F 39/14
9,605,371 B2 * 3/2017 Colucci ..... D06F 37/42
2004/0104582 A1 * 6/2004 Hwang ..... D06F 39/14 292/121

FOREIGN PATENT DOCUMENTS

DE 2810667 A1 * 9/1979 ..... D06F 37/42
DE 3605960 A1 * 8/1987 ..... D06F 37/42
DE 10358013 A1 6/2004
EP 1645706 A2 * 4/2006 ..... D06F 37/42
EP 2154287 A1 * 2/2010 ..... D06F 37/42
JP 2012011092 A 1/2012
WO 20130181289 A1 12/2013

* cited by examiner

APPLIANCE LOCK

TECHNICAL FIELD

This disclosure relates generally to an appliance. In particular, this disclosure relates to a lid or door lock mechanism for the appliance.

BACKGROUND

Appliances, such as clothes washing machines, have lids or doors that close in order to prevent clothes, water and soap suds from exiting the washing machines. The lids or doors also limit access to the inside of the washing machine, in particular to a basket when the basket may be rotating. The washing machines remove water centrifugally from wet clothes by spinning the clothes at high speed in the rotating basket. It is known that modern washing machines spin at ever increasing and relatively high speeds. In order to reduce the possibility of injury to a user during such spinning of the washing machines and at other times during operation, it is known to use lock mechanisms to hold the lid or door in a closed position.

Washing machines have been provided with lock mechanisms that have closure switches to determine the position of the lid or door and disable activation of the washing machine if the lid or door is not in the closed position. It was found that the known closure switches can be circumvented by holding the switch open, for example with an instrument such as the end of a pencil, a screw driver, a finger or the like. Thus, the lid or door can be opened while the washing machine is activated.

In order to prevent tampering with and bypassing the closure switch, it is known to provide for closure sensing to ensure that the lid or door is in a proper closed position before the lock mechanism is engaged and the washing machine is activated. One such position sensor uses at least one magnet and an electrical reed switch or a mechanical switch to detect lid closure. This known solution can be complicated and expensive to incorporate into a washing machine. Thus, an improved appliance lid lock that does not suffer from the disadvantages of known lid locks is desirable.

SUMMARY

This summary is provided to introduce concepts in a simplified form that are further described below in the detailed description. This summary is not intended to identify key factors or essential features of the claimed subject matter, nor is it intended to be used to limit the scope of the claimed subject matter.

According to one aspect, an improved appliance lock is provided. The appliance lid lock includes a housing that is attachable to one of an appliance body and a lid that is movable relative to the body between an open position and a closed position. A first slider is supported for movement by the housing. A second slider is supported for movement by the housing. A striker is attachable to the other of the appliance body and lid. The striker is operably connectable with the housing upon movement of the lid to the closed position. The striker has a first portion for engaging and moving only the first slider from a first position to a second position upon movement of the lid to the closed position. The striker has a second portion for engaging and moving only the second slider from a first position to a second position upon movement of the lid to the closed position.

The first and second sliders being in the second positions enable activation of the appliance. Structure minimizes the ability to move the first and second sliders to the second position by substantially anything but the striker and thereby prevent activation of the appliance.

According to one aspect, the structure includes a separator attached to the housing and located between the sliders. The first and second portions of the striker span the separator.

According to another aspect, the structure includes the sliders being spaced apart a predetermined distance. The first and second portions of the striker span the predetermined distance.

According to yet another aspect, an appliance lock comprises a housing that is attachable to one of an appliance body and a lid that is movable relative to the body between an open position and a closed position. A first slider is supported for movement by the housing. A second slider is supported for movement relative to the housing in unison with the first slider. A third slider is supported for movement relative to the housing. A striker is attachable to the other of the appliance body and lid. The striker is operatively connectable with the housing upon movement of the lid to the closed position. The striker has a first portion for engaging and moving only the second slider from a first position to a second position upon movement of the lid to the closed position. The striker has a second portion for engaging and moving only the third slider from a first position to a second position upon movement of the lid to the closed position. The first and third sliders being in the second positions are indicative of the lid being in the closed position and activation of the appliance may be enabled.

The following description and drawings set forth certain illustrative embodiments, aspects and implementations. These are indicative of but a few of the various ways in which one or more aspects may be employed. Other aspects, advantages, and novel features will become apparent from the following detailed description when considered in conjunction with the accompanying drawings.

DETAILED DESCRIPTION

Figure 1:
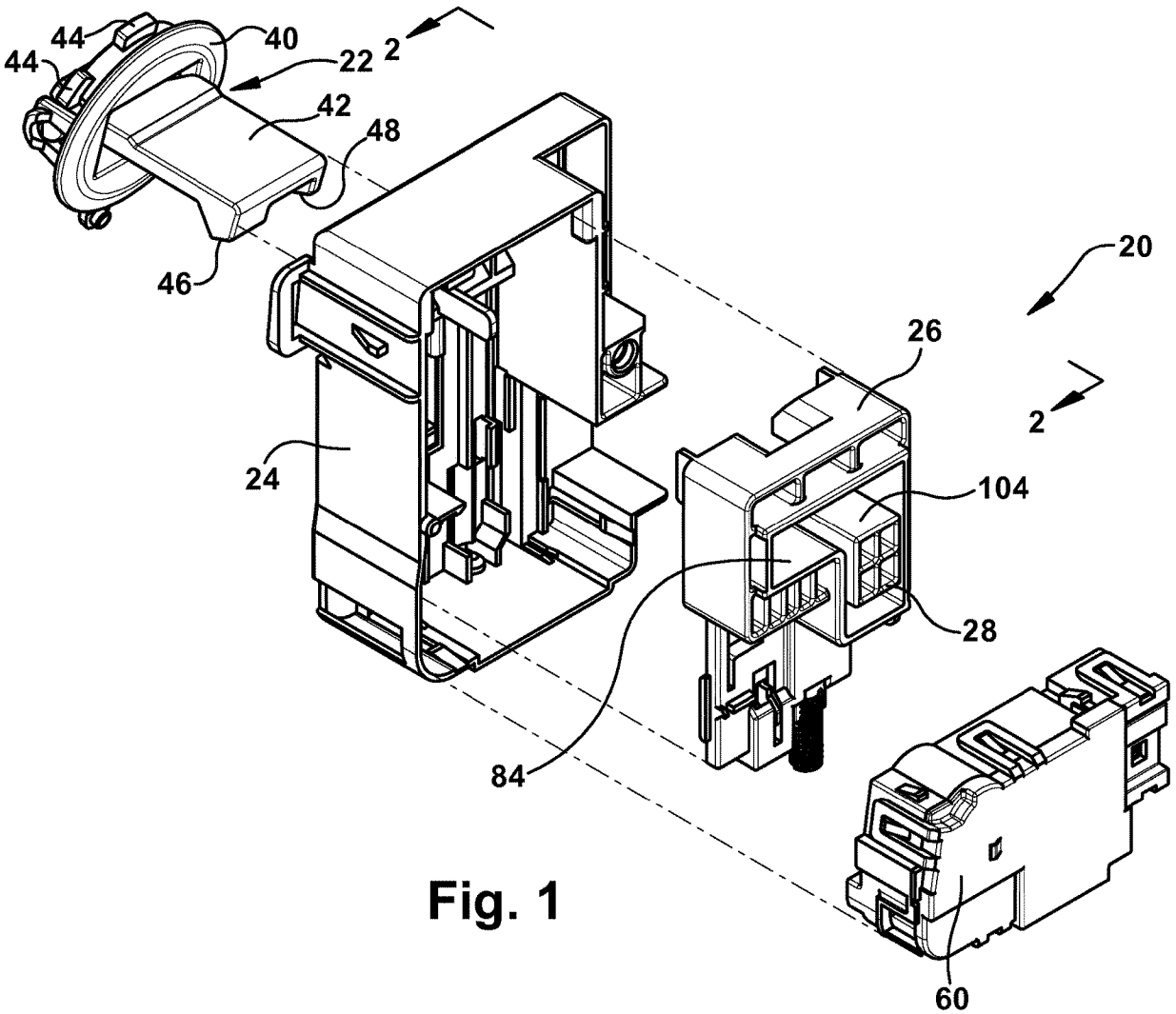
FIG. 1 is an exploded perspective view of an appliance lid lock assembly, according to one aspect.

The claimed subject matter is described with reference to the drawings, in which like reference numerals are used to refer to like elements throughout. In the following description, for purposes of explanation, numerous specific details are set forth in order to provide an understanding of the claimed subject matter. It will be apparent, however, that the claimed subject matter can be practiced without these specific details.

An appliance, such as a top load washing machine (not shown), includes a body including a frame. The washing machine also includes a lid or door that is pivotally movable relative to the body between an open position and a closed position.

The washing machine includes an improved lid lock assembly 20 (FIG. 1), according to one aspect, that is relatively simple and economical to incorporate into the washing machine. The lid lock assembly 20 has anti-tamper and safeguard features that do not suffer from disadvantages of previously known lid locks.

The lid lock assembly 20 is operatively attached to the washing machine. The lid lock assembly 20 serves several functions. The lid lock assembly 20 senses when the lid is in a closed position, indicates that the lid of the washing machine is in the closed position and retains the lid in the closed position during activation of the washing machine.

The lid lock assembly 20 includes a striker assembly 22, a housing 24, a first or main slider 26 and a second or door slider 28. Preferably, the striker assembly 22 is attached to the lid of the washing machine and the housing 24 is attached to the body or frame of the washing machine. It is contemplated that the striker assembly 22 could be attached to the body or frame of the washing and the housing be attached to the lid of the washing machine. The striker assembly 22, housing 24, main slider 26 and door slider 28 are made from any suitable material, such as molded plastic.

The striker assembly 22 (FIG. 2) includes a mounting portion 40 and a striker 42. The mounting portion 40 mechanically attaches to the lid of the washing machine by snapping the mounting portion into an opening formed in the lid. Tabs 44 on the mounting portion 40 retain the striker assembly 22 in the lid of the washing machine. The mounting portion 40 supports the striker 42 for relative pivotal movement. The striker 42 pivots relative to the mounting portion 40, as will be described below, when the lid of the washing machine moves to the closed position and is received in the housing 24. The striker 42 includes a first contact portion 46 and a second contact portion 48 spaced from the first contact portion.

The lid lock assembly 20 also includes a switch assembly 60 (FIG. 1). The switch assembly 60 is in electrical communication with a controller of the washing machine. The switch assembly 60 interfaces with the main slider 26 and the door slider 28. The switch assembly 60 operates in response to the respective positions of the main slider 26 and the door slider 28. The switch assembly 60 converts the respective positions of the sliders 26, 28 into electrical signals that can be processed by the controller (not shown) of the washing machine, such as a microprocessor.

The first or main slider 26 (FIGS. 2 and 3) is supported in the housing 24 for relative reciprocal linear movement. It will be appreciated that the housing 24 may support the main slider 26 for other types of movement, for example pivotal movement. The main slider 26 is biased towards a first position, to the right as viewed in FIGS. 2 and 3, by a spring 80. The main slider 26 is movable from the first position to a second position to the left as viewed in FIG. 2. When the main slider 26 is in the first position, it is indicative of the lid of the washing machine not being in the closed position. When the main slider 26 is in the second position, to the left as viewed in FIGS. 2 and 3, it is indicative of the lid of the washing machine being in the closed position.

The main slider 26 includes a locking rib 82 for interaction with the switch assembly 60. The locking rib 82 is receivable within a locking pin (not shown) in the switch assembly 60 to prevent movement of the main slider 26 to the right, as viewed in FIG. 2, and maintain the main slider in the second position and to hold the lid in the closed position. The main slider 26 also includes a striker engaging surface 84. The main slider 26 also has a pair of spaced apart actuation ramps 103. The actuation ramps 103 interact with the switch assembly 60 to move a component of the switch assembly to a position that signals the controller in the washing machine that the lid is in the closed position.

Figure 2:
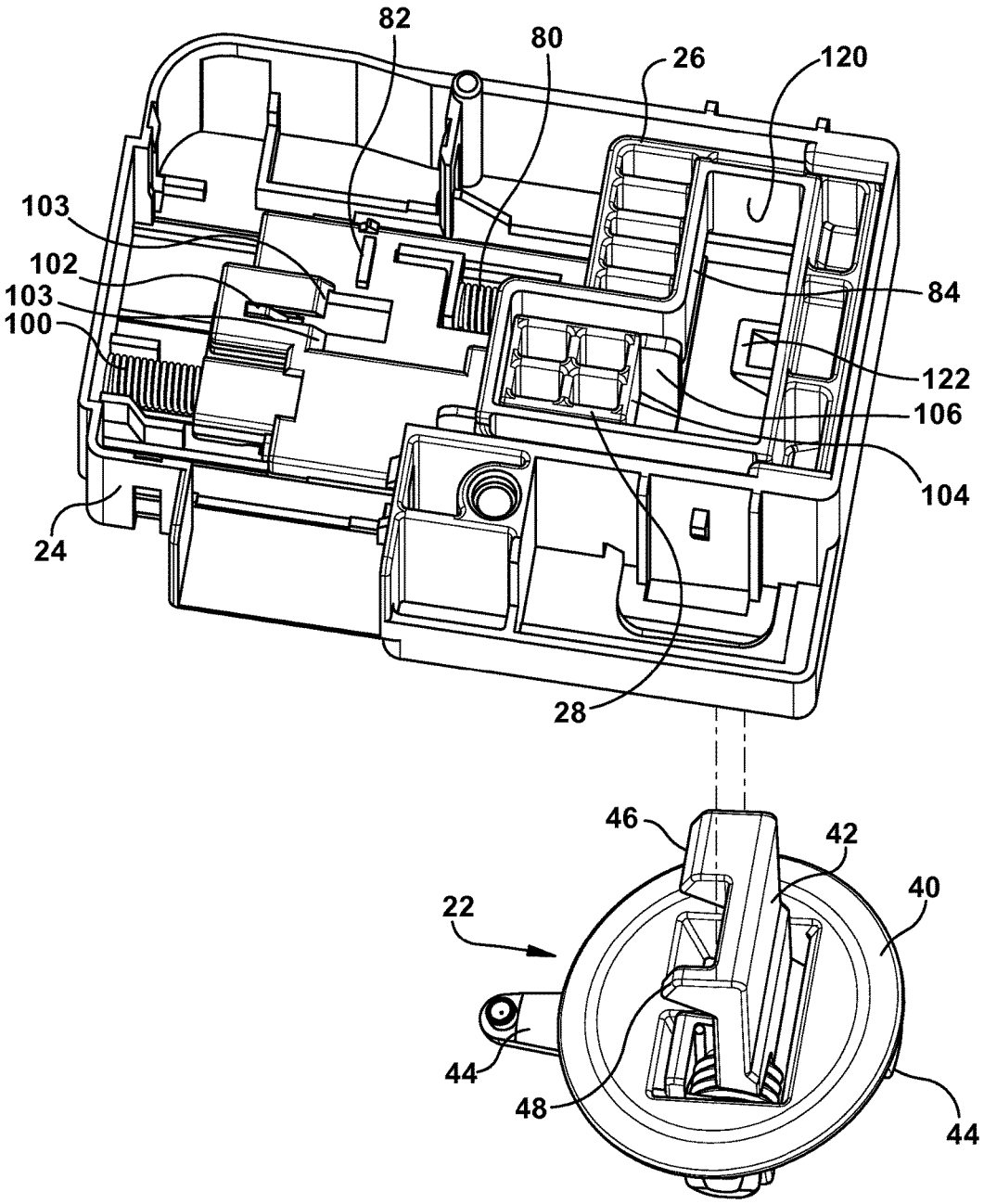
FIG. 2 is an enlarge perspective view of a portion of the appliance lid lock assembly illustrated in FIG. 1 and viewed approximately along the line 2-2 in FIG. 1.
Figure 3:
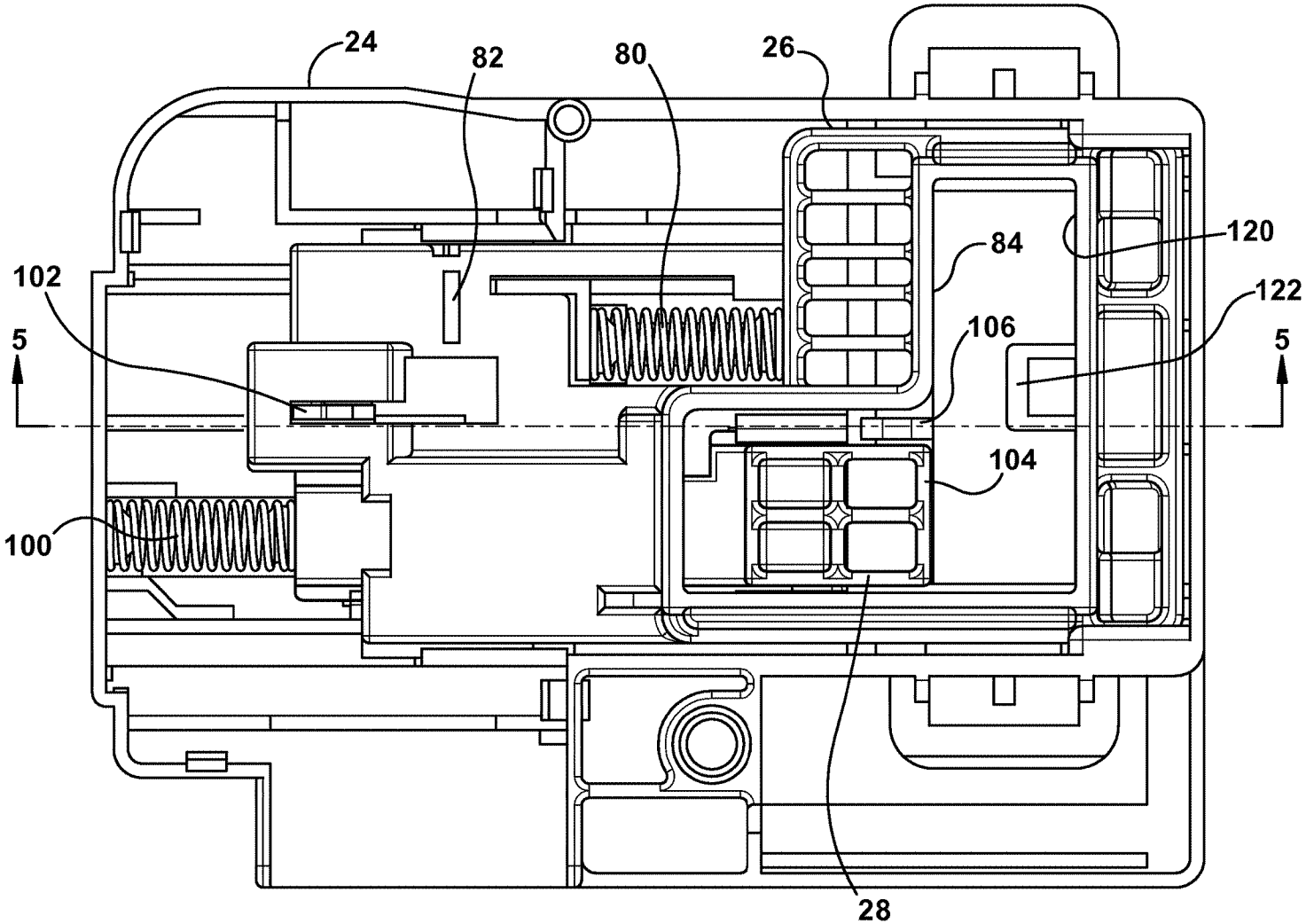
FIG. 3 is a plan view of the portion of the appliance lid lock assembly illustrated in FIG. 2.
Figure 4:
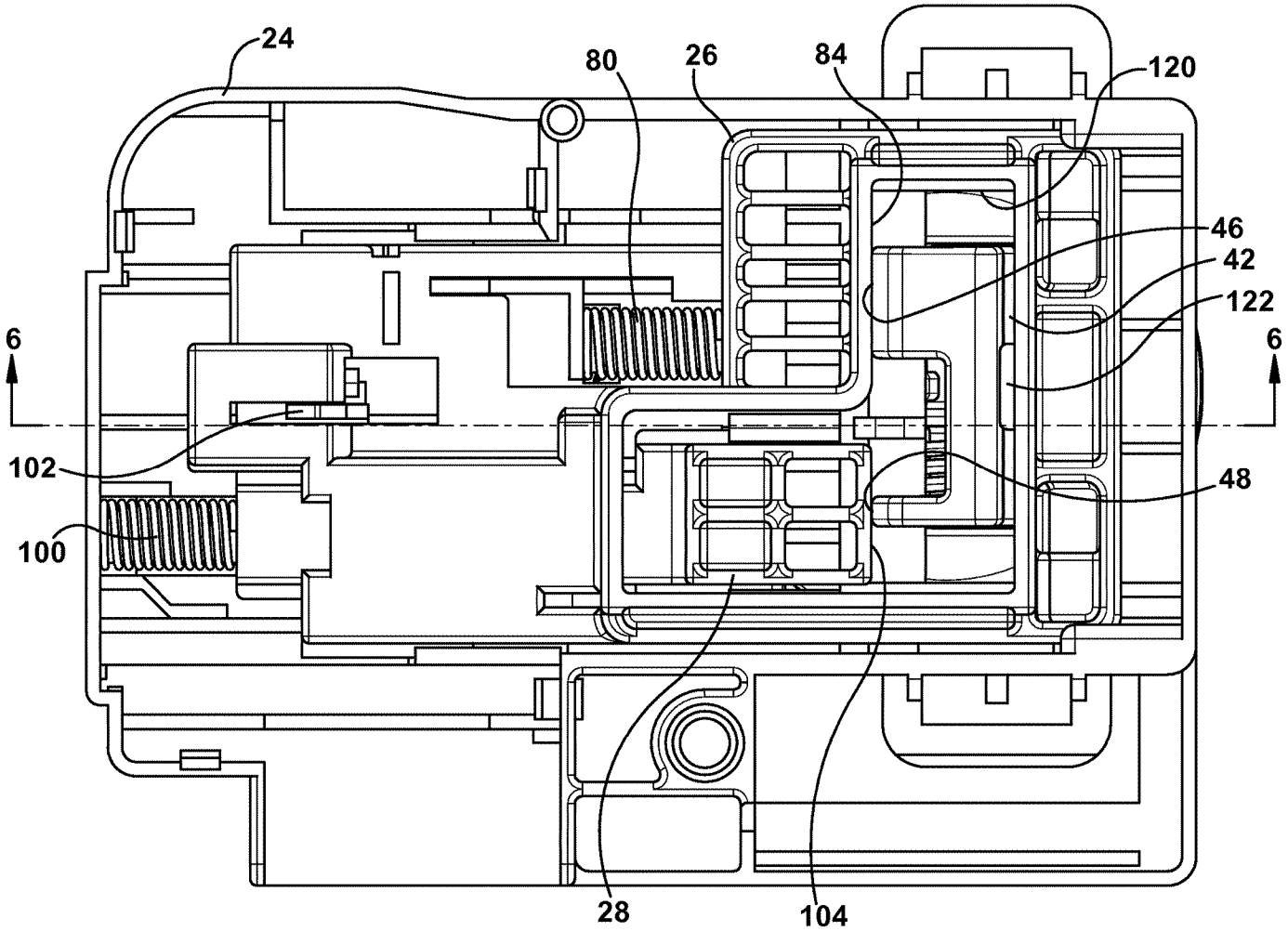
FIG. 4 is a view similar to FIG. 3 with parts in different positions.

The second or door slider 28 is supported in the housing 24 for relative reciprocal linear movement. It will be appreciated that the housing 24 may support the door slider 28 for other types of movement, for example pivotal movement. The door slider 28 is at least partially positioned within the main slider 26. It is contemplated that is not necessary that the door slider 28 be positioned wholly or partially within the main slider 26. The door slider 28 is biased to a first position, to the right as viewed in FIGS. 2 and 3, by spring 100. The door slider 28 is movable from the first position to a second position to the left as viewed in FIG. 2. The door slider 28 is illustrated in FIG. 2 in its second position for ease of understanding. When the door slider is in the first position it is indicative of the lid of the washing machine not being in the closed position.

The door slider 28 includes and actuation ramp 102. The actuation ramp 102 interacts with the switch assembly 60 to signal the controller in the washing machine that the lid is in the closed position. The door slider 28 also includes a striker engaging surface 104.

The striker engaging surface 84 of the main slider 26 and the striker engaging surface 104 of the door slider 28 are separated by a separator wall 106 that forms part of the housing 24. The separator wall 106 is located on the housing 24 at a location that the separator wall has a surface that is essentially coplanar with the striker engaging surface 84 of the main slider 26 and the striker engaging surface 104 of the door slider 28. The separator wall 106 essentially prevents or minimizes the ability of a single instrument, such as a tool, accessory or finger, from engaging both of the striker engaging surfaces 84, 104 at the same time and moving the main slider 26 and the door slider 28 towards their respective second positions. Such concurrent movement of the main slider 26 and door slider 28 to the second position would mislead the switch assembly 60 and the controller of the washing machine to believe that the lid is in the closed position and that is appropriate to activate the washing machine. This is an undesirable occurrence to be avoided.

Figure 5:
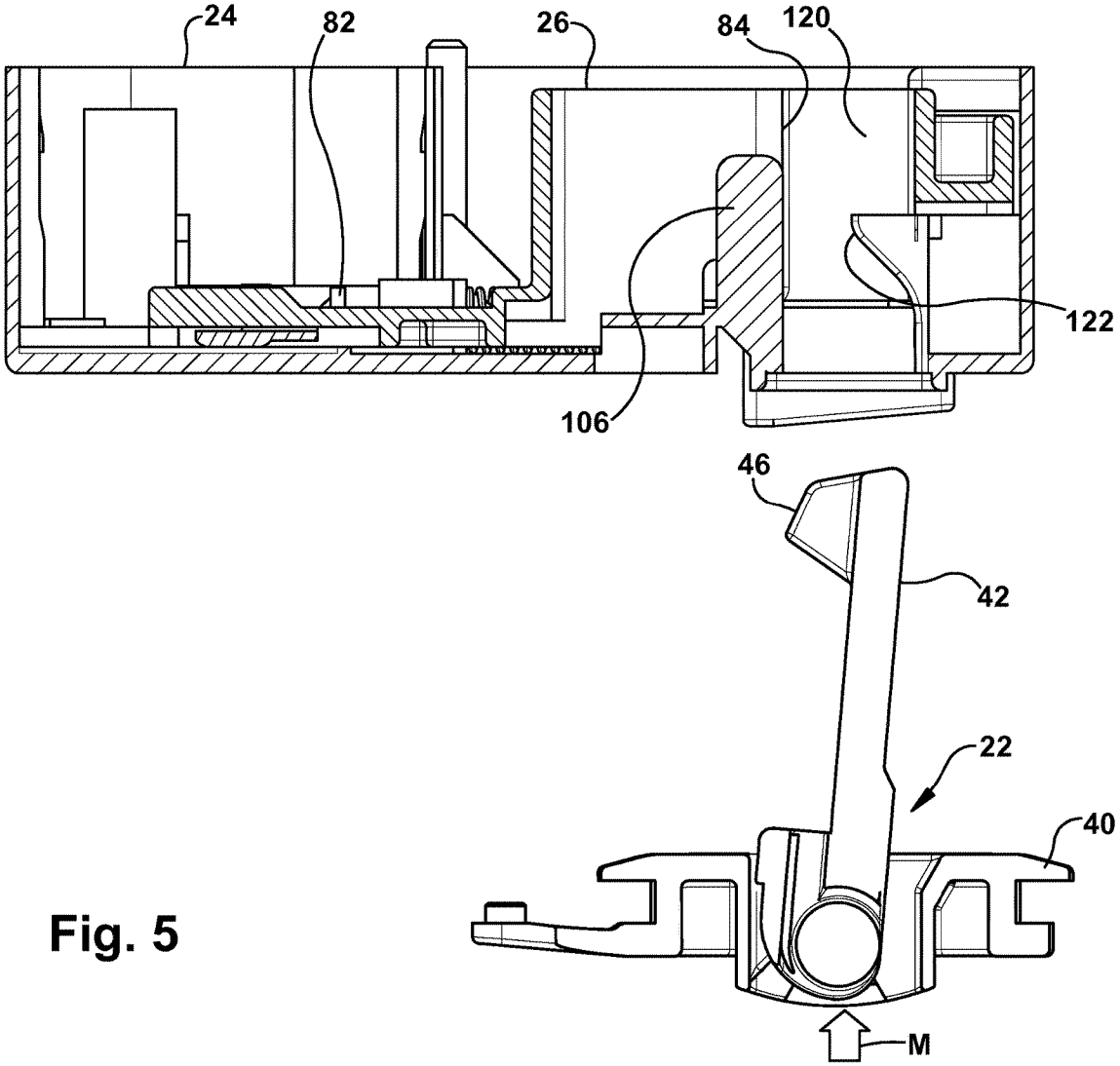
FIG. 5 is a cross-sectional view of the appliance lid lock assembly in one condition, taken approximately along line 5-5 in FIG. 3.

The housing 24 along with the main slider 26 and door slider 28 defines an opening 120 (FIGS. 3 and 5) for receiving at least a portion of the striker 42. The width (taken in a direction orthogonal to the direction of movement of the main slider 26 and door slider 28) of the striker 42 is at least one half of the width of the opening 120 so the striker always engages the main slider 26 and the door slider 28 no matter where the striker is located transversely within the opening.

Figure 6:
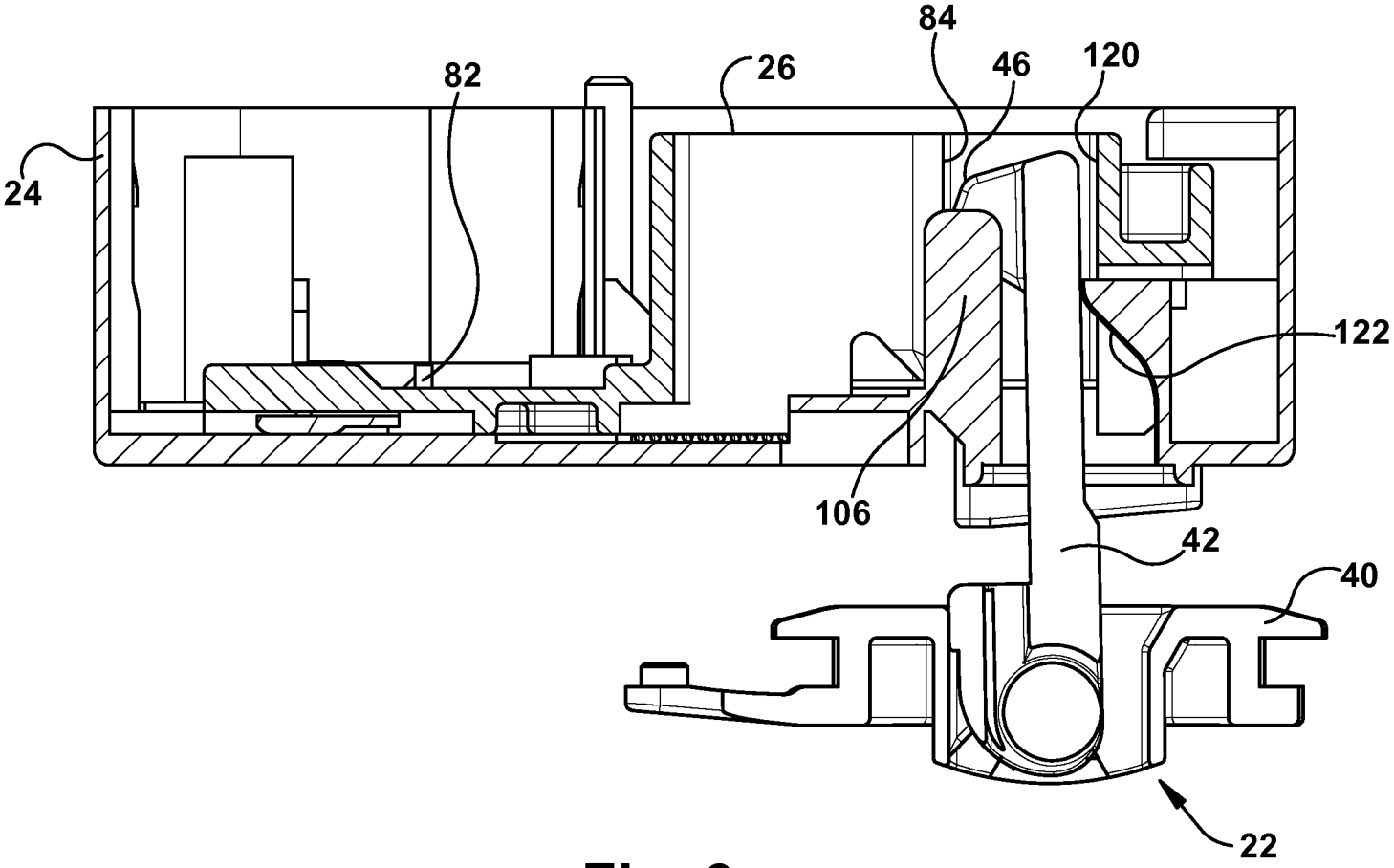
FIG. 6 is a cross-sectional view, similar to FIG. 5, of the appliance lid lock assembly in another condition and taken approximately along 6-6 in FIG. 4.

A cam 122 is formed integrally with the housing 24. The cam 122 extends into the opening 120 and is substantially centered in the opening 120. The striker 42 moves into the opening 120 when the lid of the washing machine is moved to its closed position. The cam 122 engages the striker 42 upon movement of the striker into the opening 120. The cam 122 forces the striker 42 to pivot counterclockwise, as viewed in FIG. 5, to the position illustrated in FIG. 6.

The first contact portion 46 of the striker 42 is spaced apart from the second contact portion 48 of the striker. The first and second contact portions 46, 48 of the striker 42 are spaced apart a sufficient distance to span the separator wall 106. The first contact portion 46 of the striker 42 only engages the first contact surface 84 of the main slider 26. The second contact portion 48 of the striker 42 only engages the second contact surface 104 of the main slider 26. Thus, only the proper instrument, such as the striker 42 with the first and second contact portions 46, 48 can move the main and door sliders 26, 28 concurrently. When the lid of the washing machine moves to the closed position, the striker 42 moves in the direction indicated by the arrow M (FIG. 5) into the lower end, as viewed in FIG. 5, of the opening 120 to the position illustrated in FIG. 6.

As the striker 42 moves into the opening 120 the cam 122 forces the striker to pivot relative to the mounting 40 and lid of the washing machine. As the striker 42 pivots, the first contact portion 46 of the striker 42 engages the striker contact surface 84 of the main slider 26 and moves the main slider to the second position. The second contact portion 48 of the striker 42 engages the striker contact surface 104 of the door slider 28 and moves the door slider to the second position. When the switch assembly 60 determines that both the main slider 26 and door slider 28 have moved to their respective second positions, the switch assembly signals to the controller that the lid is in its closed position. The controller may then allow activation of the washing machine.

Figure 7:
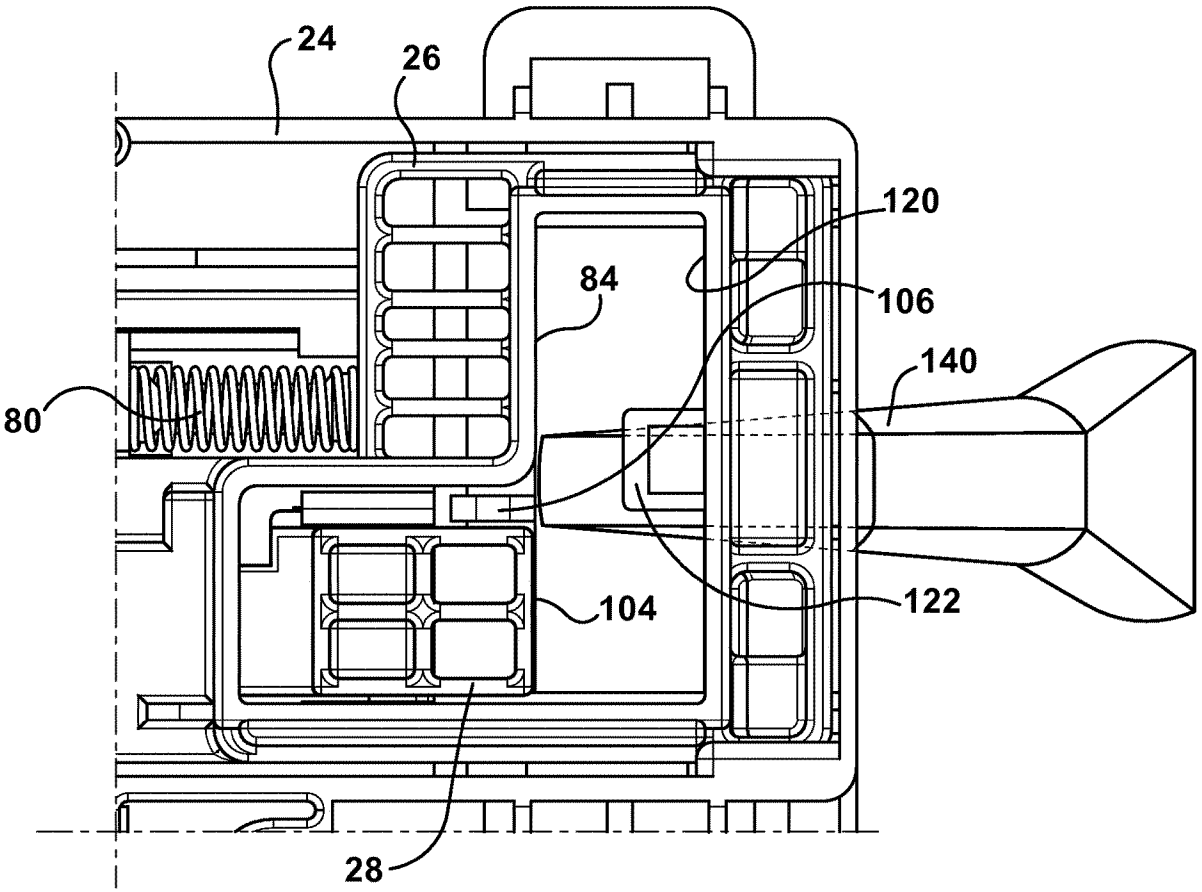
FIG. 7 is a plan view of a portion of the appliance lid lock assembly illustrated in FIG. 3, illustrating an anti-tamper feature.

In operation, if someone were to attempt to insert a single instrument, such as a tool, accessory or finger (such as an industry standard UL Finger 140 illustrated in FIG. 7), the separator wall 106 would engage such an instrument. The separator wall 106 would engage such instrument and prevent, or at least make it extremely difficult, to concurrently move the main slider 26 and the door slider 28 towards the second position. Thus, according to one aspect, the separator wall 106 acts as a deterrent or anti-tamper feature of the appliance lid lock assembly 20 by requiring the specific design of the striker 42 illustrated in FIG. 2 having spaced apart contact portions 46, 48 to engage and move the main and door sliders 26, 28.

Figure 8:
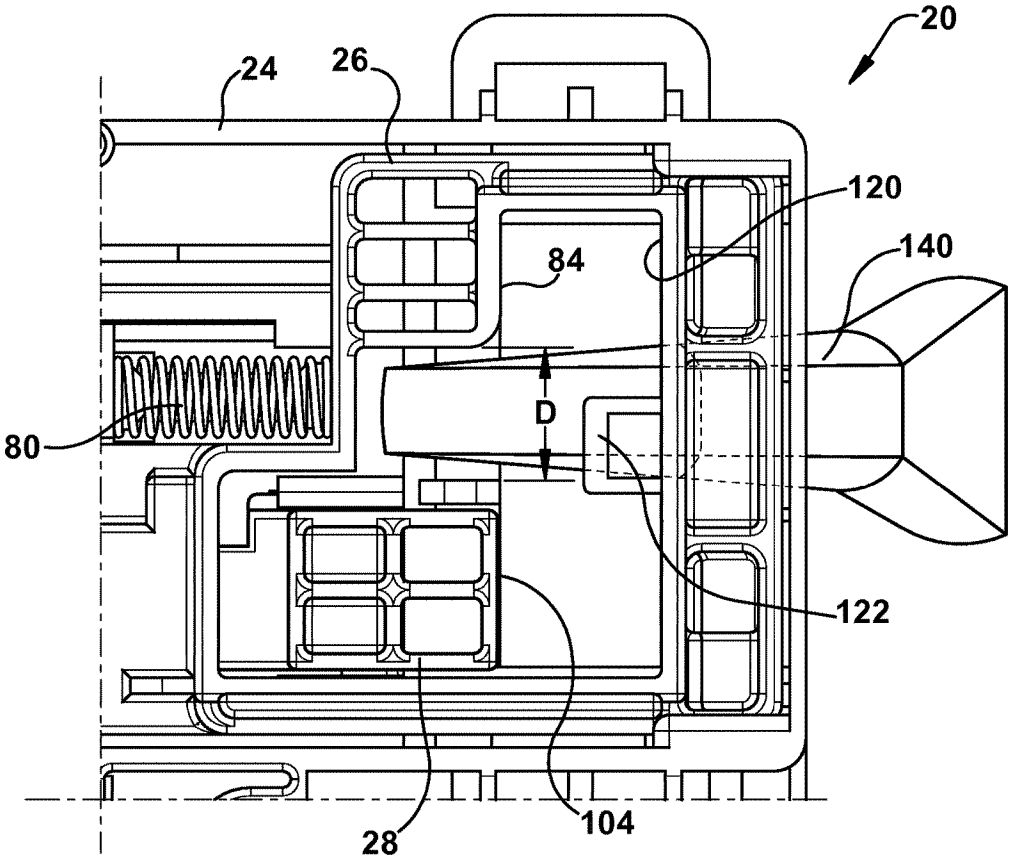
FIG. 8 is a plan view of a portion of the appliance lid lock mechanism, illustrating another anti-tamper feature.

The washing machine may include an improved lid lock assembly 20 (FIG. 8), according to another aspect. The lid lock assembly 20 is operatively attached to the washing machine. The lid lock assembly 20 serves several functions. The lid lock assembly 20 senses when the lid is in a closed position, indicates that the lid of the washing machine is in the closed position and retains the lid in the closed position during activation of the washing machine.

The lid lock assembly 20 includes a striker assembly 22, a housing 24 a first or main slider 26 and a second or door slider 28. Preferably, the striker assembly 22 is attached to the lid of the washing machine and the housing 24 is attached to the body or frame. It is contemplated that the striker assembly 22 could be attached to the body or frame of the washing and the housing be attached to the lid.

The striker assembly 22 includes a mounting portion 40 and a striker 42. The mounting portion 40 mechanically attaches to the lid of the washing machine by snapping it into an opening formed to the approximate shape of the mounting portion. Tabs 44 on the mounting portion 40 retain the striker assembly 22 in the lid of the washing machine. The mounting portion 40 supports the striker 42 four relative pivotal movement. The striker 42 pivots, as will be described below, when the lid of the washing machine is in the closed position. The striker 42 includes a first contact portion 46 and a second contact portion 48.

The lid lock assembly 20 also includes a switch assembly (not shown). The switch assembly is and electrical communication with a controller of the washing machine. The switch assembly interfaces with the main slider 26 and door slider 28. The switch assembly can sense the mechanical positions of the main slider 26 and the door slider 28 and converts the sensed position into electrical signals that can be processed by a controller of the washing machine.

The first or main slider 26 is supported in the housing 24 for relative reciprocal linear movement. It will be appreciated that the housing 24 may support the main slider 26 for other types of movement, for example pivotal movement. The main slider 26 is biased towards a first position, to the right as viewed in FIG. 8, by a spring 80. The main slider 26 is movable from the first position to a second position. When the main slider 26 is in the first position, it is indicative of the lid of the washing machine not being in the closed position. When the main slider 26 is in the second position, to the left as viewed in FIG. 8, it is indicative of the lid of the washing machine being in the closed position. The main slider 26 includes a locking rib 82 for interaction with the switch assembly. The main slider 26 also includes a striker engaging surface 84.

The second or door slider 28 is supported in the housing 24 for relative reciprocal linear movement. It will be appreciated that the housing 24 may support the door slider 28 for other types of movement, for example pivotal movement. The door slider 28 is partially positioned with in the main slider 26. It is contemplated that is not necessary that the door slider 28 be position wholly or partially within the main slider 26. The door slider 28 is biased to a first position, shown to the right as viewed in FIG. 8. The door slider 28 is movable from the first position to a second position. When the door slider is in the first position it is indicative of the lid of the washing machine not being in the closed position. The door slider 28 also includes a striker engaging surface 104.

The housing 24 along with the main slider 26 and door slider 28 defines an opening 120 for receiving at least a portion of the striker 42. A cam 122 is formed with the housing 24. The cam 122 extends into the opening 120. The cam 122 engages the striker 42 upon movement of the striker into the opening 120 defined by the housing 24, main slider 26 and door slider 28. The striker 42 moves into the opening 120 when the lid of the washing machine is moved to its closed position.

The first contact portion 46 of the striker 42 is spaced apart from the second contact portion 48 of the striker. The first and second contact portions 46, 48 of the striker 42 are spaced apart distance D. The distance D is greater than the width of an instrument such as the industry standard UL finger 140. Thus, only the proper instrument, such as the striker 42 with the first and second contact portions 46, 48 can move the main and door sliders 26, 28 concurrently. When the lid of the washing machine moves to the closed position, the striker 42 moves into the opening 120. As the striker 42 moves into the opening 120 the cam 122 forces the striker to pivot relative to the mounting 40 and lid of the washing machine. As the striker 42 pivots the first contact portion 46 of the striker engages the striker contact surface 84 of the main slider.

Concurrent movement of the main slider 26 and door slider 28 to the second position would mislead the controller of the washing machine to believe that the lid is in the closed position and that is okay to activate the washing machine. This is an undesirable occurrence to be avoided.

If someone were to attempt to insert a single instrument, such as a tool, accessory or finger (such as an industry standard UL Finger illustrated in FIG. 8), the distance D is large enough so that the instrument has little or no chance of engaging and concurrently move both the main slider 26 and the door slider 28 in a direction towards the second position. Thus, according to this aspect, the distance D acts as a deterrent or anti-tamper feature of the appliance lid lock assembly 20 by requiring the specific design of the striker 42 illustrated in FIG. 2 having spaced apart contact portions 46, 48 to engage and move the main and door sliders 26, 28.

The washing machine appliance may alternatively include an improved lid lock assembly 220 (FIG. 9), according to yet another aspect, that is also relatively simple and economical to incorporate into the washing machine. The lid lock assembly 220 includes mechanical anti-tamper and safeguard features that do not suffer from disadvantages of previously known lid locks.

The lid lock assembly 220 is operatively attached to the washing machine. The lid lock assembly 220 serves several functions. For example, the lid lock assembly 220 includes a safeguard feature that senses when a lid of the washing machine is in a closed position, indicates that the lid of the washing machine is in the closed position, retains the lid in the closed position during activation of the washing machine and includes anti-tamper structure that minimizes the chances of being able to bypass the safeguard feature.

The lid lock assembly 220 includes a striker assembly 222 and a housing 224. Preferably, the striker assembly 222 is attached to the lid of the washing machine and the housing 224 is attached to the body or frame of the washing machine. It is contemplated that the striker assembly 222 could be attached to the body or frame of the washing and the housing be attached to the lid of the washing machine.

The lid lock assembly 220 also includes a first or main slider 226, a second or auxiliary slider 228 and a third or door slider 230. The auxiliary slider 228 and door slider 230 are positioned in the main slider 226 for relative linear movement. The striker assembly 222, housing 224, main slider 226, auxiliary slider 228 and door slider 230 are made from any suitable material, such as molded plastic.

The striker assembly 222 (FIGS. 9 and 10) includes a mounting portion 240 and a striker 242. The mounting portion 240 mechanically attaches to the lid of the washing machine by snapping the mounting portion into an opening formed in the lid. Tabs 244 on the mounting portion 240 retain the striker assembly 222 in the lid of the washing machine. The mounting portion 240 supports the striker 242 for relative pivotal movement. It is contemplated that the mounting portion 240 could be fastened or adhered to the lid of the washing machine.

The striker 242 pivots relative to the mounting portion 240, as will be described below, when the lid of the washing machine moves to the closed position and is at least partially received inside the housing 224. The striker 242 includes a first contact portion 246 and a second contact portion 248 spaced from the first contact portion. The first contact portion 246 and second contact portion 248 of the striker 242 are illustrated as being formed as a one-piece component. However, it is contemplated that the first contact portion 246 and second contact portion 248 of the striker 242 may be formed as separate components and each supported for pivotal movement relative to the mounting portion 240. The striker 242 also includes a rib 250 that extends along the length of the striker.

Figure 9:
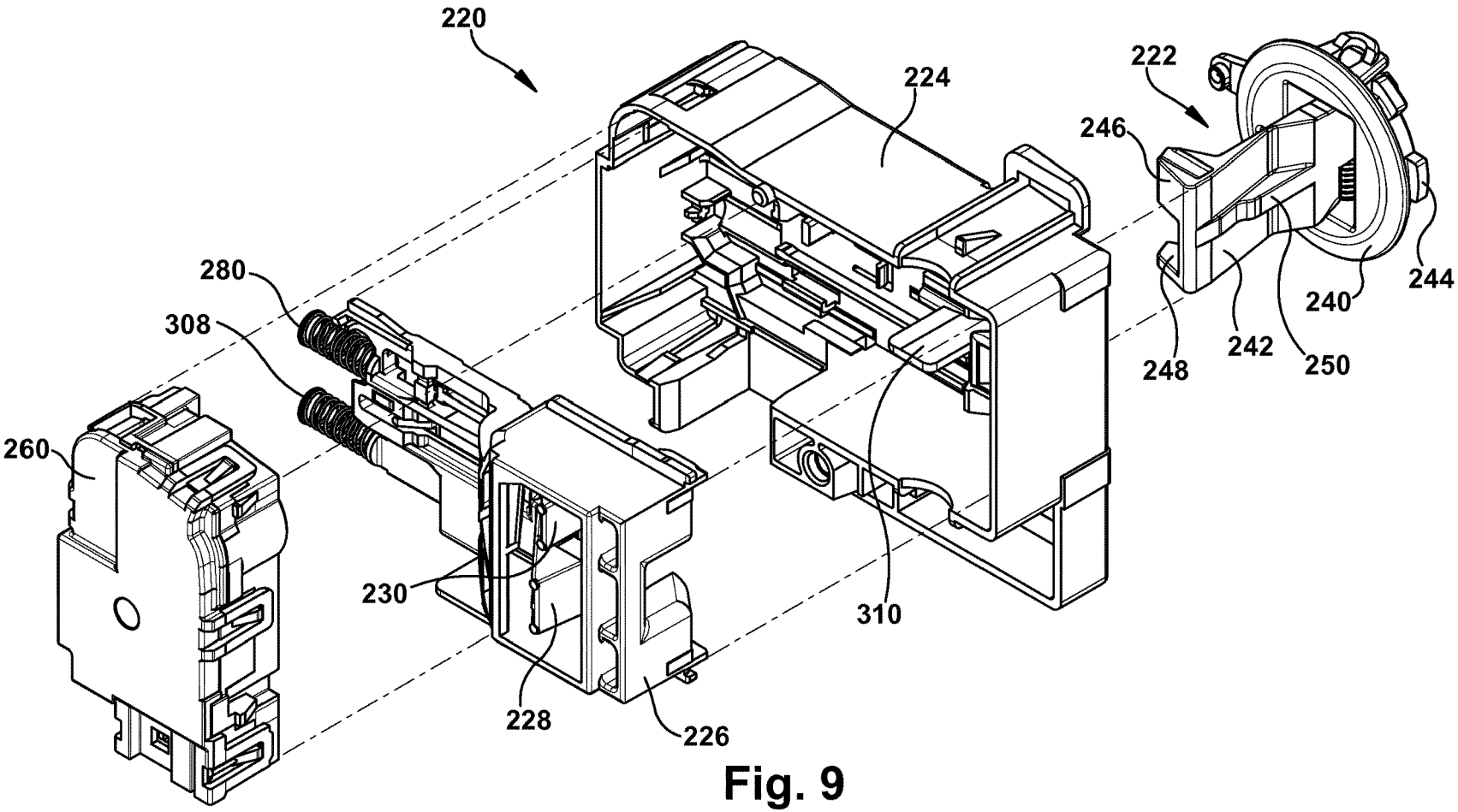
FIG. 9 is an exploded perspective view of an appliance lid lock assembly, according to another aspect.

The lid lock assembly 220 also includes a switch assembly 260 (FIG. 9). The switch assembly 260 is in electrical communication with a controller (not shown) of the washing machine, such as a microprocessor. The switch assembly 260 interfaces with the main slider 226, the auxiliary slider 228 and the door slider 230 for different functions. The switch assembly 260 operates in response to the respective positions of the main slider 226, the auxiliary slider 228 and the door slider 230. The switch assembly 260 converts the respective positions of the sliders 226, 228, 230 into electrical signals that can be processed by the controller of the washing machine.

The first or main slider 226 (FIGS. 9-16) is supported in the housing 224 for relative reciprocal linear movement. It will be appreciated that the housing 224 may support the main slider 226 for other types of movement, for example pivotal movement. The main slider 226 is biased towards a first position, to the right as viewed in FIGS. 10-12, by a spring 280. The main slider 226 is movable between an initial or first position as viewed in FIG. 11 and a second position to the left as viewed in FIG. 12. When the main slider 226 is in the initial or first position as viewed in FIG. 11, it is indicative of the lid of the washing machine not being in the closed position. When the main slider 226 is in the second position, to the left as viewed in FIG. 12, it is indicative of the lid of the washing machine being in the closed position. The main slider 226 includes a locking rib 282 for interaction with the switch assembly 260. The locking rib 282 interacts with a locking pin (not shown) in the switch assembly 260 to prevent movement of the main slider 226 to the right, as viewed in FIG. 11, and to help maintain the main slider in the second position to hold the lid of the washing machine in the closed position.

The main slider 226 also has a pair of spaced apart actuation ramps 332. The actuation ramps 332 interact with the switch assembly 260 to move a component of the switch assembly to a position that signals the controller in the washing machine that the lid is in the closed position.

The second or auxiliary slider 228 is supported by and in the housing 224 and the main slider 226 for relative reciprocal linear movement (FIGS. 10-12 and 17). It will be appreciated that the housing 224 and main slider 226 may support the auxiliary slider 228 for other types of movement, for example pivotal movement. The auxiliary slider 228 is at least partially positioned within the main slider 226. It is contemplated that is not necessary that the auxiliary slider 228 be positioned wholly or partially within the main slider 226.

Figure 11:
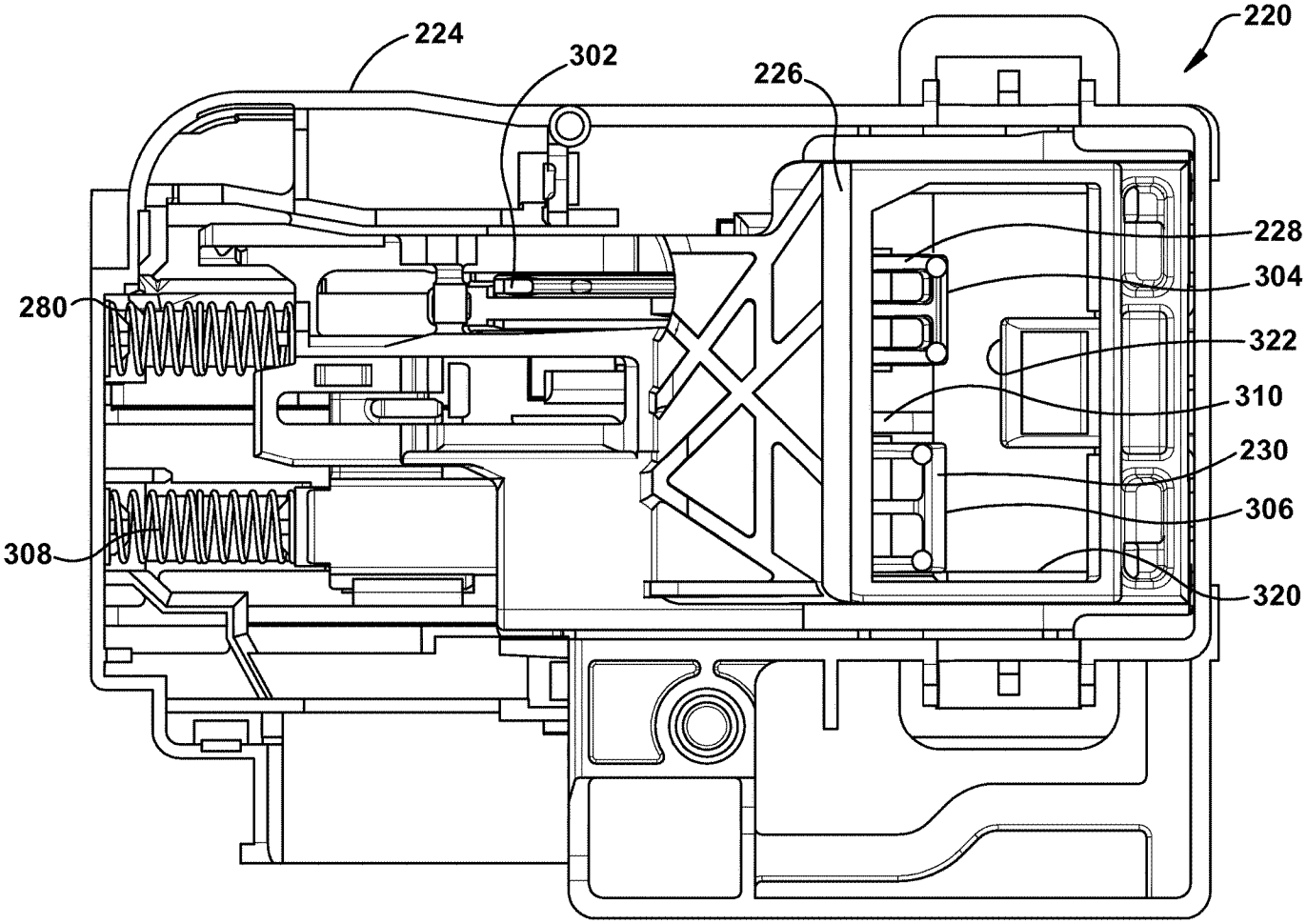
FIG. 11 is a plan view of the portion of the appliance lid lock assembly illustrated in FIG. 10.
Figure 12:
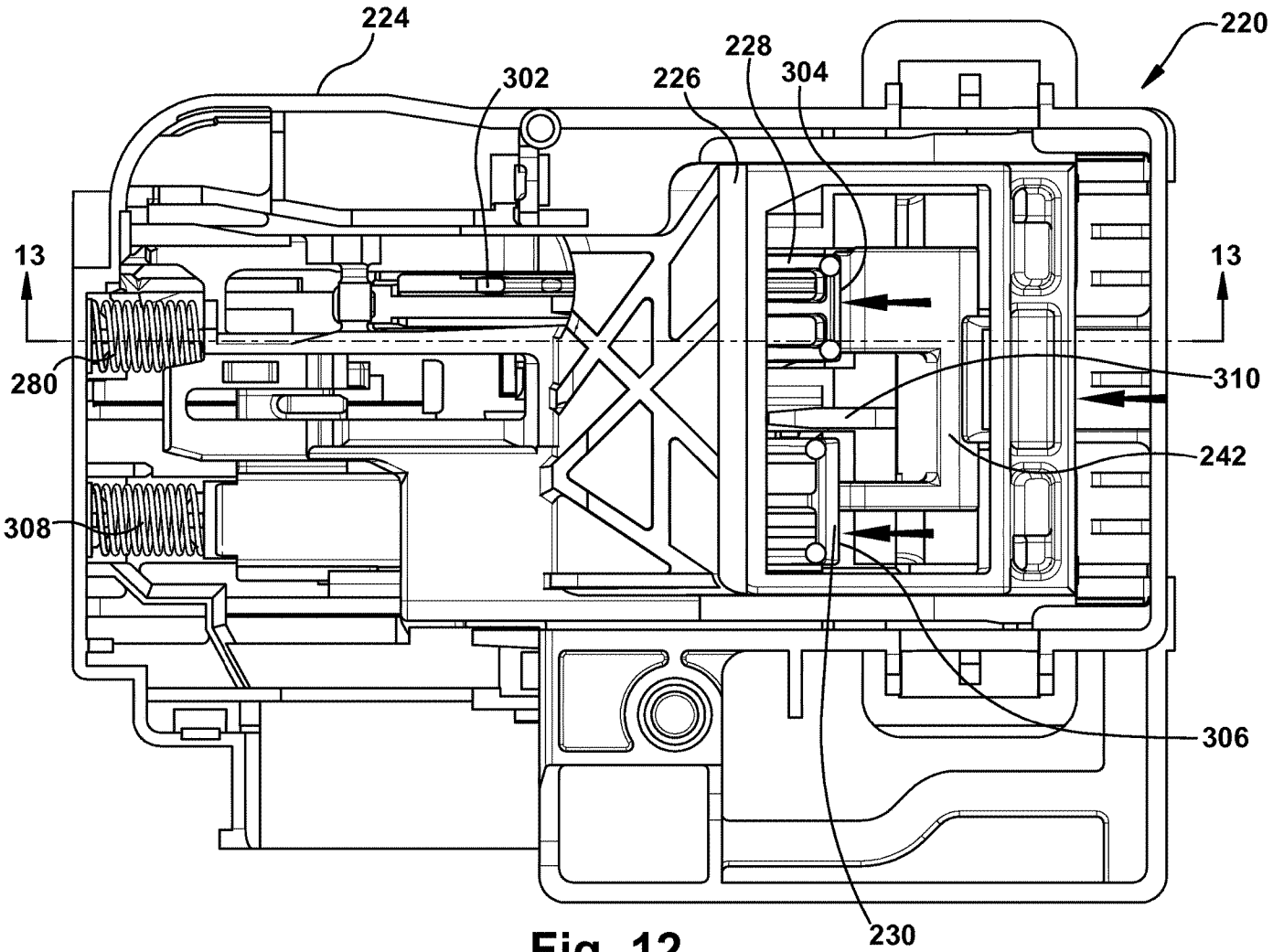
FIG. 12 is a view similar to FIG. 11 with parts in different positions.

The auxiliary slider 228 is movable between an initial or first position as viewed in FIG. 11 and a second position to the left as viewed in FIG. 12. The auxiliary slider 228 is illustrated in FIG. 12 in its second position for ease of understanding. When the auxiliary slider 228 is in the first position it is indicative of the lid of the washing machine not being in the closed position. When the auxiliary slider 228 is in the second position it is indicative of the lid of the washing machine being in the closed position.

Figure 10:
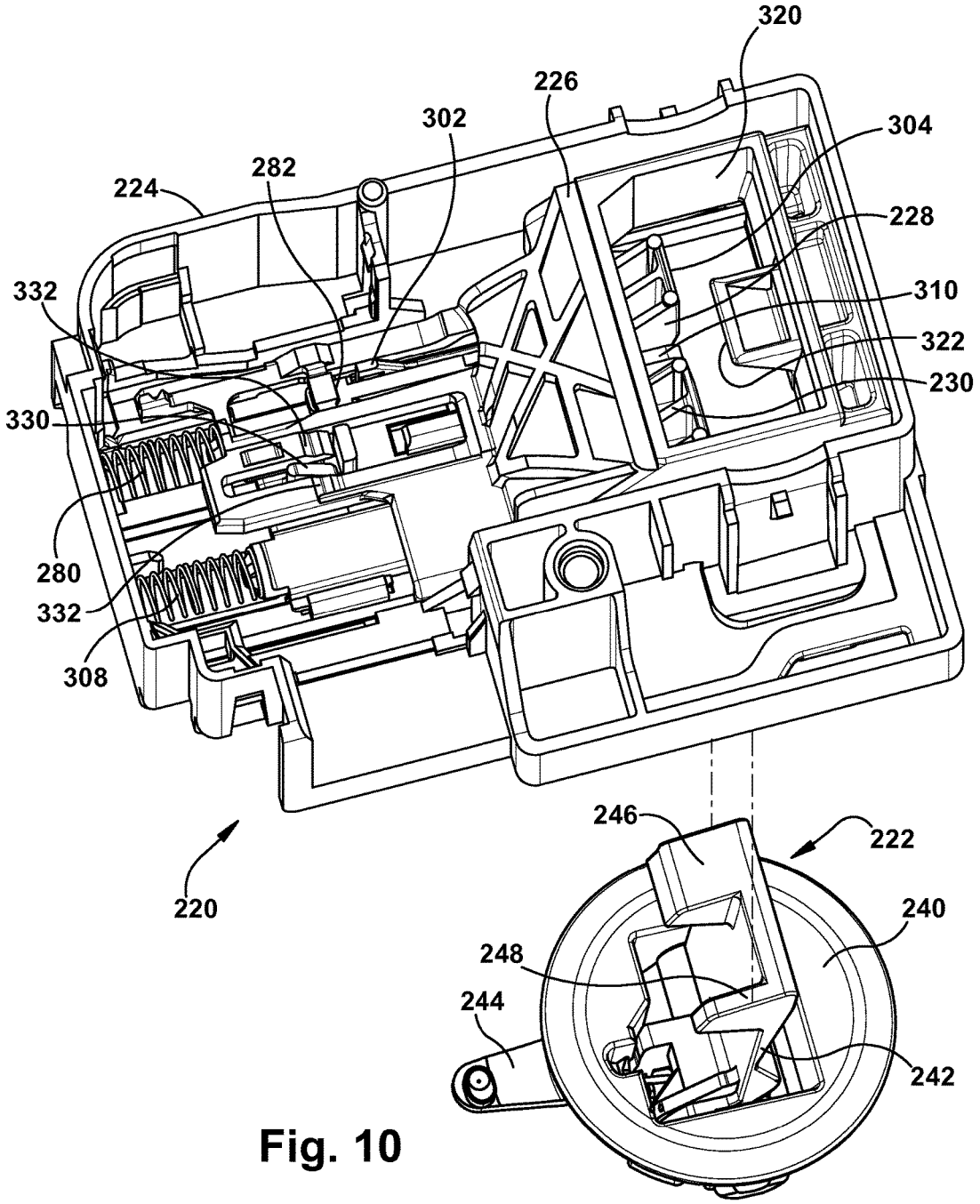
FIG. 10 is an enlarge perspective view of a portion of the appliance lid lock assembly illustrated in FIG. 9.

The housing 224 includes a wall 302 (FIGS. 10-12). The wall 302 cooperates with an elongate opening in the auxiliary slider 228 and an elongate opening in the main slider 226. The wall 302 guides and supports the auxiliary slider 228 and main slider 226 for controlled movement relative to the housing 224 and the auxiliary slider relative to the main slider.

Figure 19:
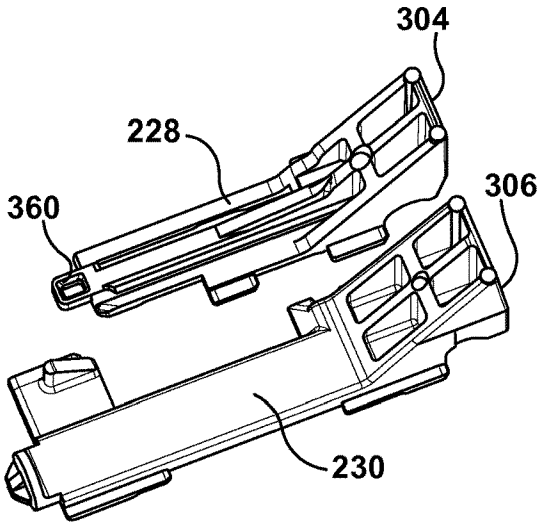
FIG. 19 is a perspective view of two slider components of the appliance lid lock assembly illustrated in FIG. 17.
Figure 17:
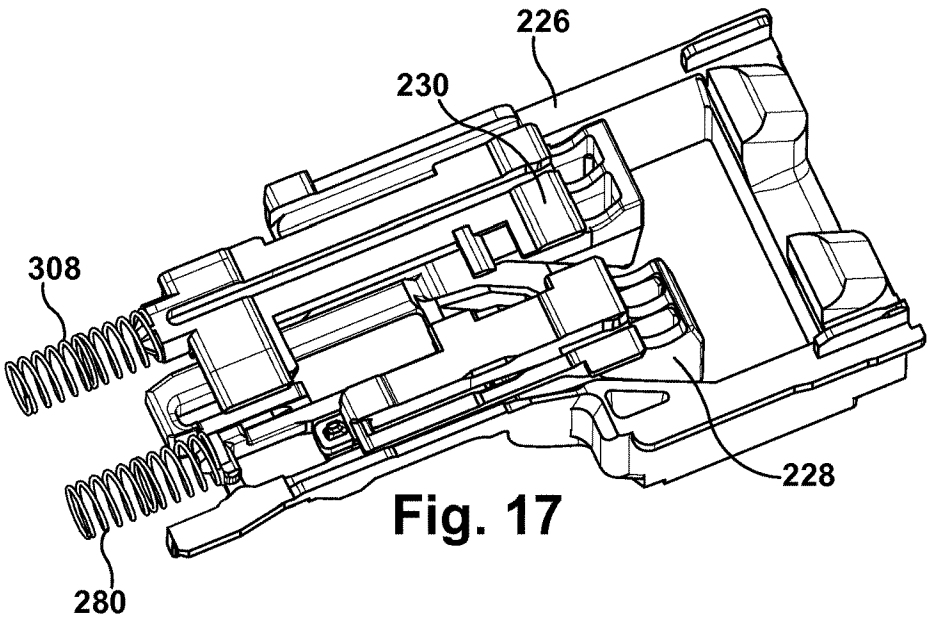
FIG. 17 is a perspective view of slider components of the appliance lid lock assembly.
Figure 18:
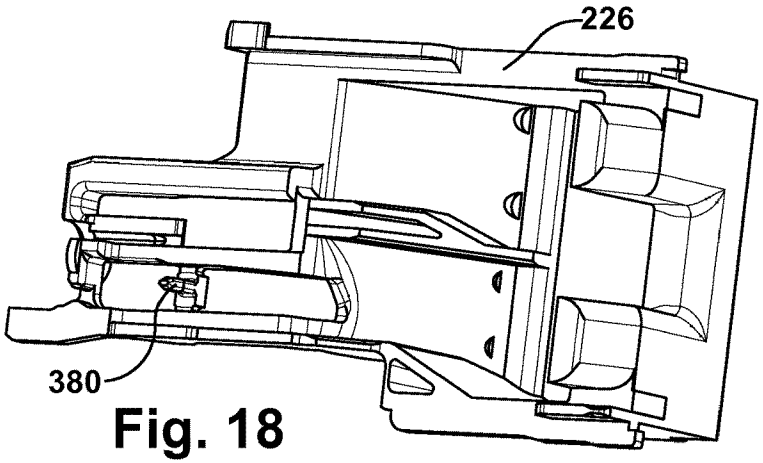
FIG. 18 is a perspective view of a slider component of the appliance lid lock assembly illustrated in FIG. 17.

The auxiliary slider 228 also includes a striker engaging surface 304. The striker engaging surface 304 is to be contacted by the first contact portion 246 of the striker 242 when the striker moves into the housing 224 to move the auxiliary slider 228 in unison with the main slider 226 from their first positions to their second positions indicating that the lid of the washing machine is in its closed position. The auxiliary slider 228 has an end portion opposite the striker engaging surface 304 with an opening 360 (FIG. 19). The opening 360 of the auxiliary slider 228 interacts and cooperates with a frangible projection 380 (FIG. 18) on the main slider 226 to maintain the auxiliary slider and the main slider moving in unison.

The third or door slider 230 is supported in the housing 224 for relative reciprocal linear movement (FIGS. 10-12). It will be appreciated that the housing 224 may support the door slider 230 for other types of movement, for example pivotal movement. The door slider 230 is at least partially positioned within the main slider 226. It is contemplated that is not necessary that the door slider 230 be positioned wholly or partially within the main slider 226. The door slider 230 includes and actuation ramp 330. The actuation ramp 330 interacts with the switch assembly 260 to signal the controller in the washing machine that the lid is in the closed position.

Figure 14:
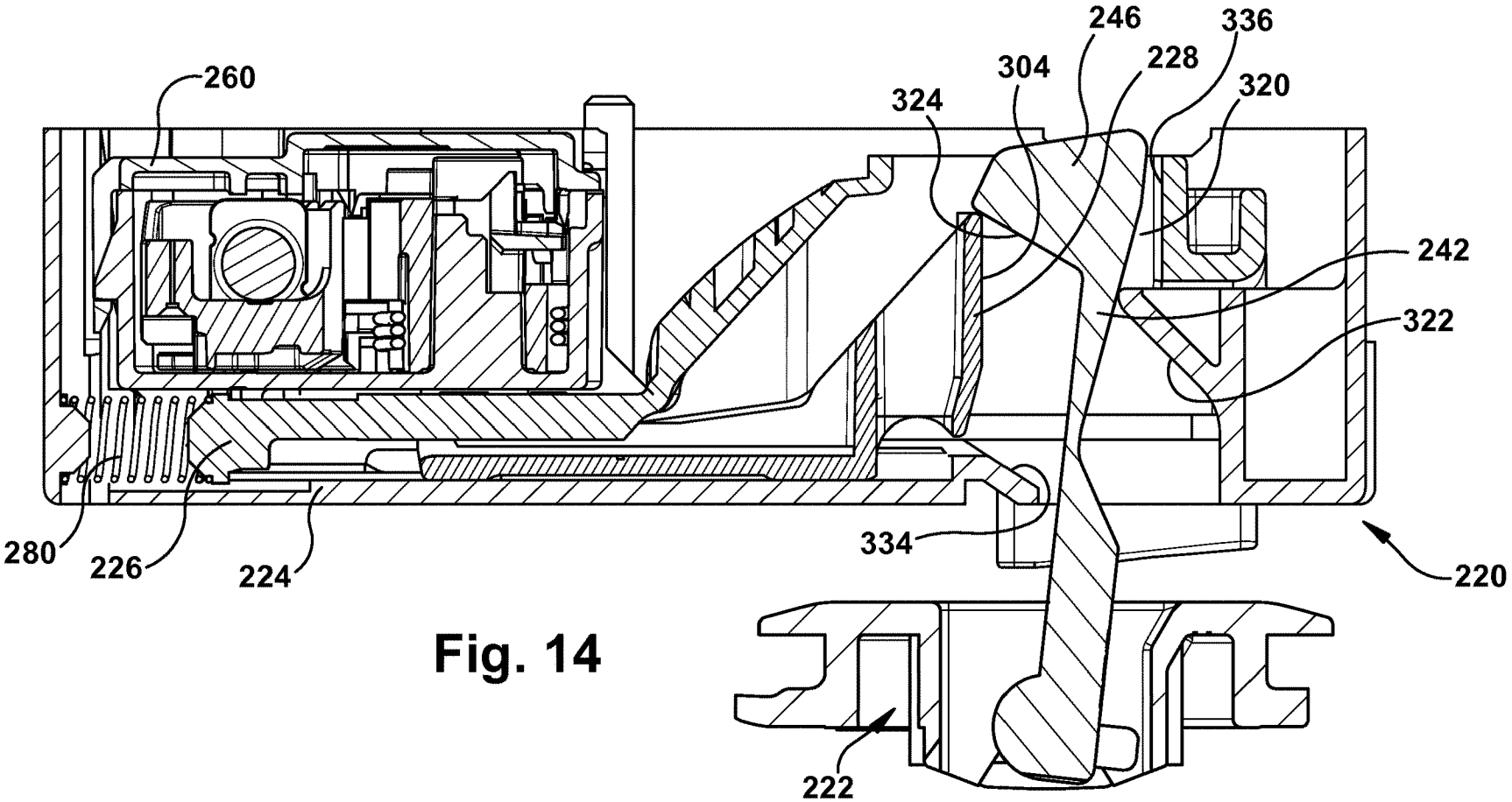
FIG. 14 is a cross-sectional view, similar to FIG. 13, of the appliance lid lock assembly with parts in another condition.
Figure 15:
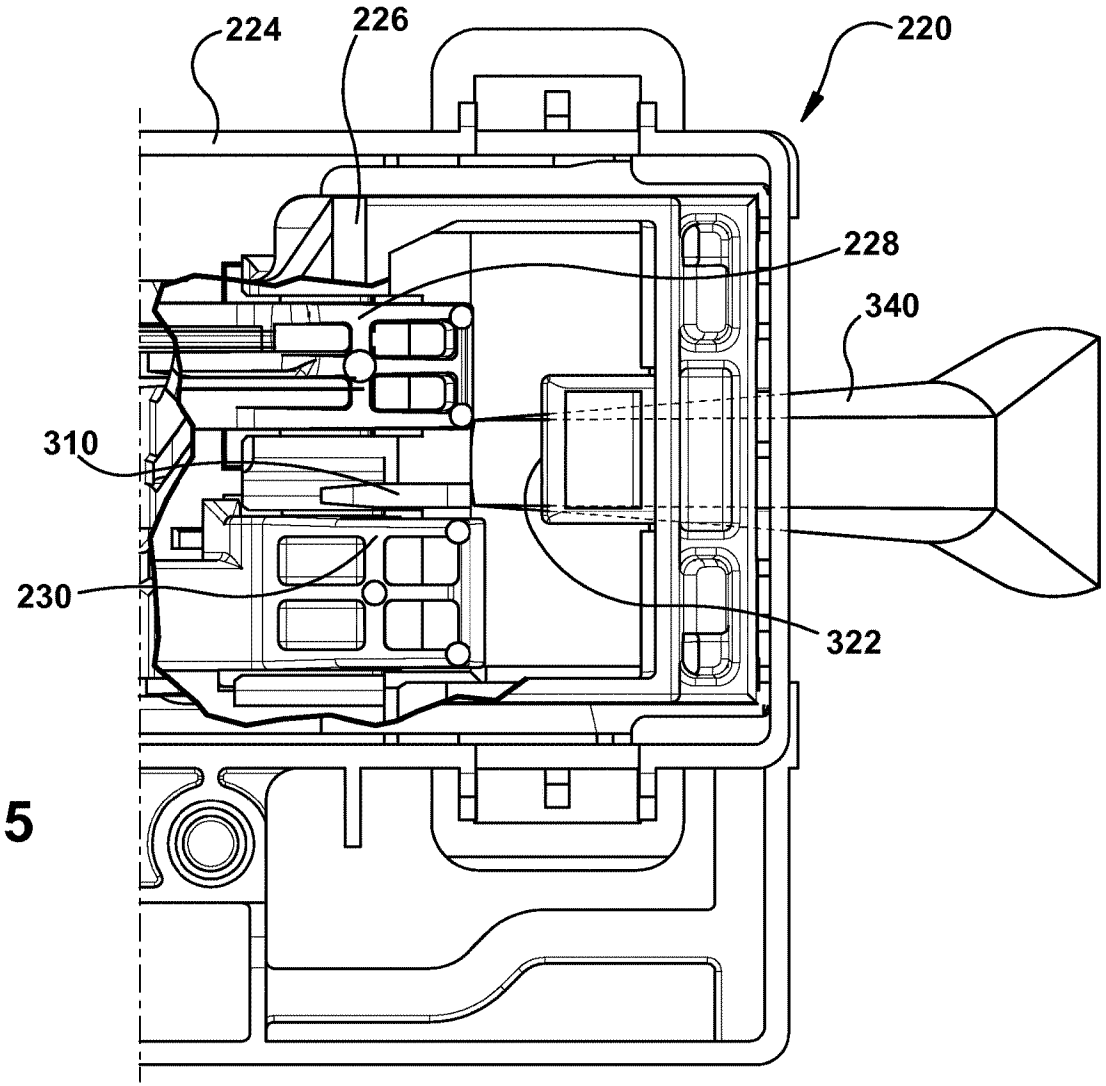
FIG. 15 is a plan view of a portion of the appliance lid lock assembly illustrated in FIG. 11, illustrating an anti-tamper feature.

The door slider 230 is biased to a first position, to the right as viewed in FIGS. 10 and 14, by a spring 308. The door slider 230 also includes a striker engaging surface 306. The striker engaging surface 306 of the door slider is to be contacted by when the striker 242 moves into the housing 224 to move the door slider from its first position to its second position indicating that the lid of the washing machine is in its closed position.

The striker engaging surface 304 of the auxiliary slider 228 and the striker engaging surface 306 of the door slider 230 are separated by a separator wall 310 (FIGS. 10-12 and 15-16) that forms part of the housing 224. The separator wall 310 is positioned on the housing 224 at a location that the separator wall has a surface that is essentially coplanar with the striker engaging surface 304 of the auxiliary slider 228 and the striker engaging surface 306 of the door slider 230 when the auxiliary slider and door slider are in their initial or first positions. The separator wall 310 provides an anti-tamper feature that essentially prevents or minimizes the ability of a single instrument, such as a tool, accessory or finger, from engaging both of the striker engaging surfaces 304, 306 at the same time and moving the auxiliary slider 228, the door slider 230 and ultimately the main slider 226 towards their respective second positions. Such concurrent movement of the auxiliary slider 228, the door slider 230 and the main slider 226 to the second position would mislead the switch assembly 260 and the controller of the washing machine to believe that the lid is in the closed position and that is appropriate to activate the washing machine. This is an undesirable occurrence to be avoided.

The first contact portion 246 of the striker 242 is spaced apart from the second contact portion 248 of the striker. The first and second contact portions 246, 248 of the striker 242 are spaced apart a sufficient distance to span the separator wall 310. The first contact portion 246 of the striker 242 only engages the first contact surface 304 of the auxiliary slider 228. The second contact portion 248 of the striker 242 only engages the second contact surface 306 of the door slider 230. Thus, only the proper component, such as the striker 242 with the first and second contact portions 246, 248 can move the auxiliary and door sliders 228, 230 concurrently and, thus, the main slider 226.

Figure 16:
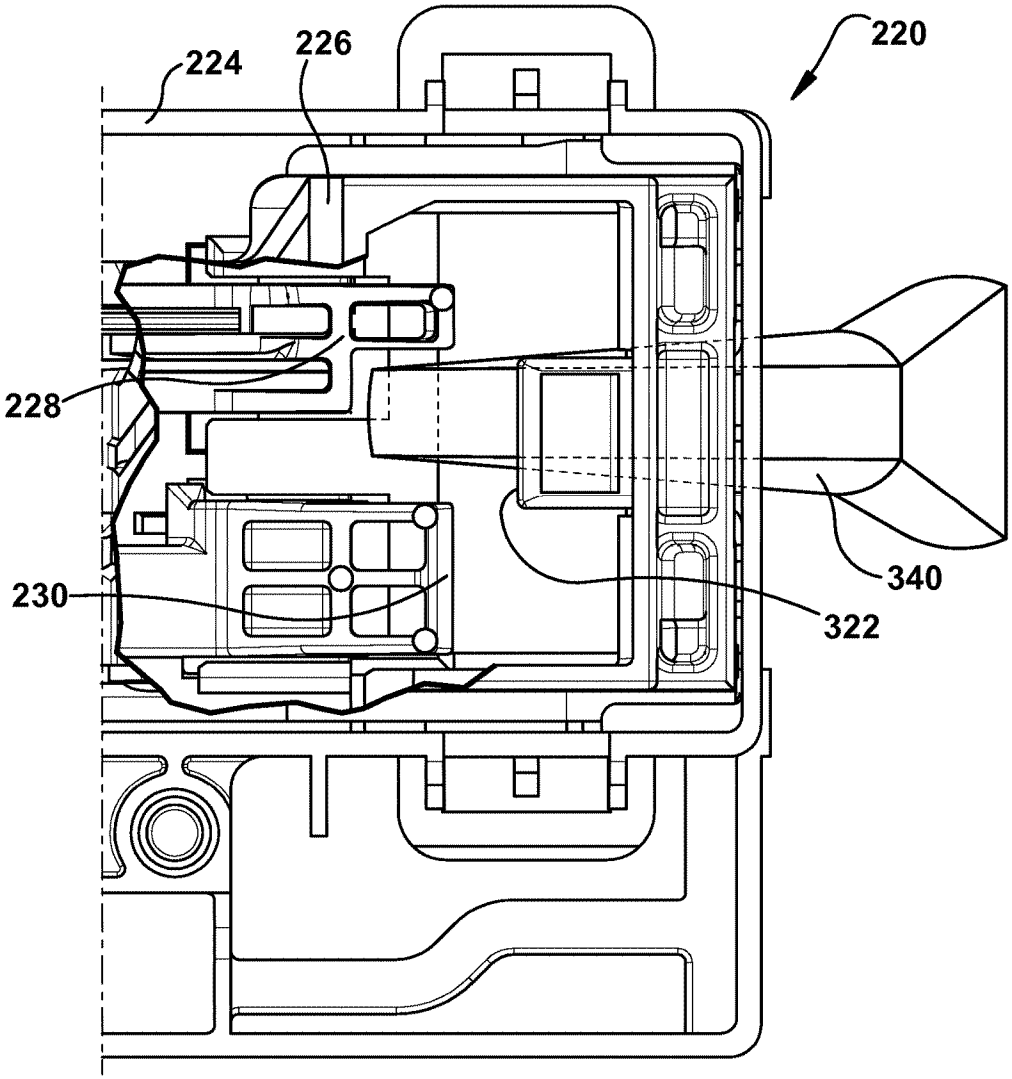
FIG. 16 is a plan view of a portion of the appliance lid lock mechanism similar to FIG. 15, illustrating an alternate anti-tamper feature.

According to an alternate aspect of the anti-tamper feature illustrated in FIG. 16, the striker engaging surface 304 of the auxiliary slider 228 and the striker engaging surface 306 of the door slider 230 are spaced apart a distance that is greater than the width of an instrument such as the industry standard UL finger 340. The first and second contact portions 246, 248 of the striker 242 are also spaced apart a distance substantially the same as the distance that the striker engaging surfaces 304, 306 are spaced. Thus, only the proper instrument, such as the striker 242 with the first and second contact portions 246, 248 can move the auxiliary and door sliders 228, 230 concurrently. When the lid of the washing machine moves to the closed position, the striker 242 moves into the opening 320. As the striker 242 moves into the opening 320 the cam 322 forces the striker to pivot relative to the mounting 240 and lid of the washing machine. As the striker 242 pivots, the first contact portion 246 of the striker engages only the striker contact surface 304 of the auxiliary slider 228 to move the auxiliary slider to its second position. Concurrently, the second contact portion 248 of the striker engages only the striker contact surface 306 of the door slider 230 to move the door slider to its second position.

The housing 224 along with the main slider 226 and auxiliary slider 228 define an opening 320 (FIGS. 10-14) for receiving at least a portion of the striker 242. The width (taken in a direction orthogonal to the direction of movement of the main slider 226 and auxiliary slider 228) of the striker 242 is at least one half of the width of the opening 320 so the striker always engages the main slider 226 and the auxiliary slider 228 no matter where the striker is located transversely within the opening.

Figure 13:
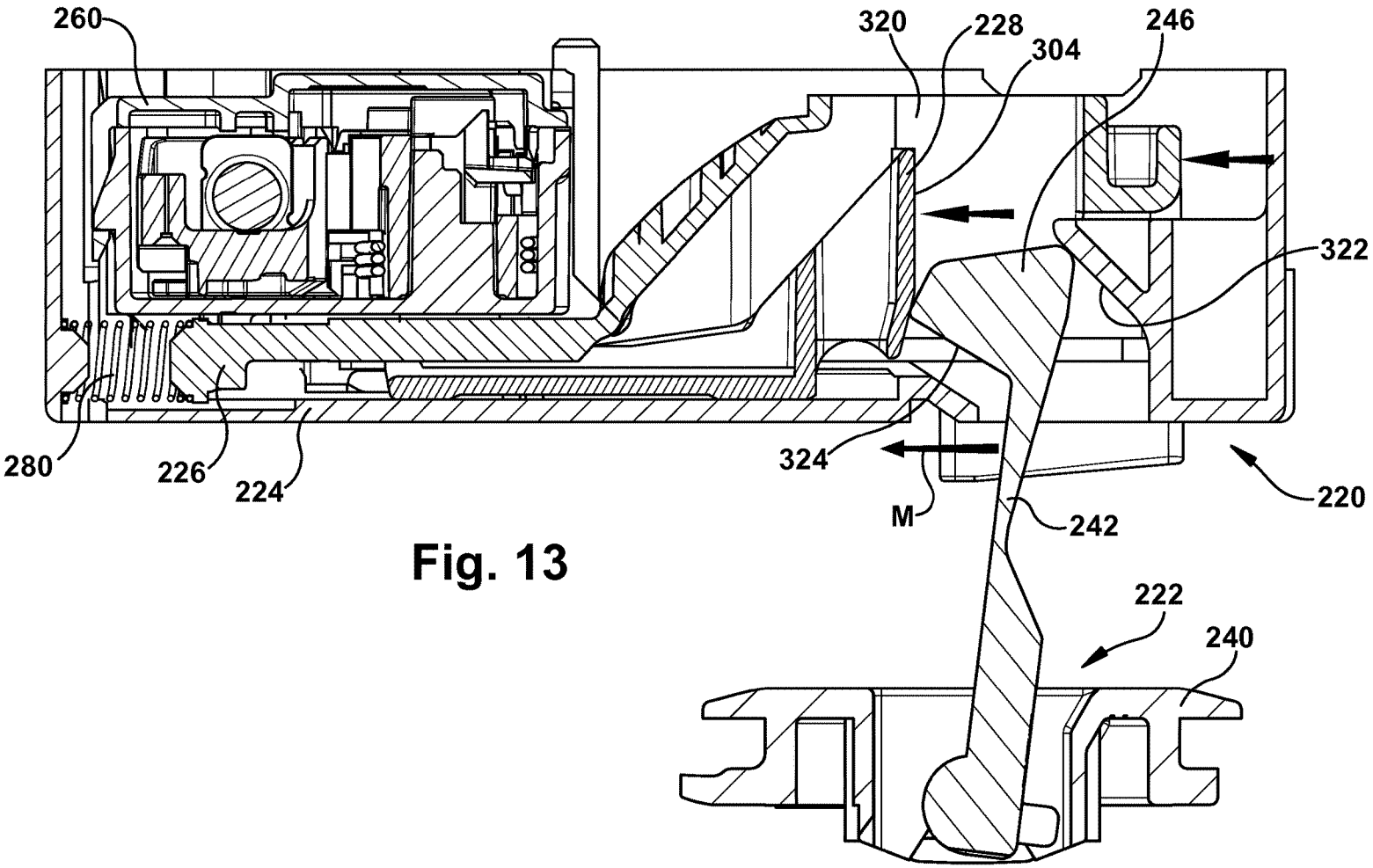
FIG. 13 is a cross-sectional view of the appliance lid lock assembly with parts in one condition, taken approximately along line 13-13 in FIG. 12.

A cam 322 is formed integrally with the housing 224. The cam 322 extends into the opening 320 and is substantially centered in the opening. The first and second contact portions 246, 248 of the striker 242 move into the opening 320 when the lid of the washing machine is moved in a direction towards its closed position. The cam 322 engages the rib 250 of the striker 242 opposite the first and second contact portions 246, 248 upon movement of the striker into the opening 320, as illustrated in FIG. 13. The cam 322 forces the striker 242 to pivot counterclockwise, from the position illustrated in FIG. 13, to the position illustrated in FIG. 14.

When the lid of the washing machine moves to the closed position, the striker 242 pivots in the direction indicated by the arrow M (FIG. 13) into the lower end, as viewed in FIG. 13, of the opening 320 to the position illustrated in FIG. 14. As the striker 242 moves into the opening 320 the cam 322 forces the striker to pivot relative to the mounting 240 and lid of the washing machine. As the striker 242 pivots the first contact portion 246 of the striker 242 engages the striker contact surface 304 of the auxiliary slider 228 and moves the auxiliary slider to the second position. Concurrently, the second contact portion 248 of the striker 242 engages the striker contact surface 306 of the door slider 230 and moves the door slider to the second position. When the switch assembly 260 determines that both the auxiliary slider 228 and door slider 230, and thus the main slider 226, have moved to their respective second positions, the switch assembly signals to the controller that the lid is in its closed position. The controller may then activate the washing machine.

In operation, if someone were to attempt to insert a single instrument 340, such as a tool, accessory or finger (such as an industry standard UL Finger illustrated in FIG. 14), the separator wall 310 would engage such an instrument. The separator wall 310 would prevent, or at least make it extremely difficult, to concurrently move the auxiliary slider 228 and the door slider 230 towards their second positions. Thus, the separator wall 310 acts as a deterrent or anti-tamper feature of the appliance lid lock assembly 220 by requiring the specific design of the striker 242 illustrated in FIGS. 9-10 having spaced apart contact portions 246, 248 to engage and move the auxiliary and door sliders 228, 230, and thus the main slider 226, to their respective second positions.

In operation, if someone were to attempt to force open the lid of the appliance washing machine when it is activated, the following would occur. A predetermined force must be applied in order to force open the lid of the washing machine in order to force the striker 242 to rotate in a clockwise direction, as viewed in FIG. 14. If sufficient force is applied to lift the lid when it is in the locked condition, ramp 334 of the housing 224 engages surface 324 of the striker 242 to try to prevent the striker from exiting the housing. At about the same time, the back of the striker 242 (opposite surface 324) will contact surface 336 on the main slider 226 in an attempt to prevent the striker from exiting the housing 224. The retention surfaces 324 on the contact portions 246, 248 of the striker 242 act on the ramp 334 of the housing 224 to force the main slider 226 to move to the right, as viewed in FIG. 14, and the back of the striker, opposite from the retention surfaces engage the main slider. When a force exceeding the predetermined force is applied to open the lid, the main slider 226 moves towards its first position relative to the auxiliary slider 228. The frangible projection 380 on the main slider 226 breaks as the locking pin of the switch assembly 260 applies a force to the locking rib 282 against the frangible projection sufficient to break the frangible projection. This allows the main slider 226 to no longer move in unison with the auxiliary slider 228 and release the striker 242. The main and door sliders 226, 230 are now in their respective first positions that indicates that the washing machine lid is no longer closed or locked. The switch assembly 260 registers this change in condition and indicates the change to the controller.

Thus, an improved lid lock assembly 20, 220 is provided that has a mechanical anti-tamper feature to prevent or minimize the chance of activating an appliance, such as a top load washing machine with a lid or door that is open. The improved lid lock assembly 20, 220 also has a mechanical safeguard feature to ensure that if the lid is forced open a certain sequence of events will occur.

Certain terminology is used herein for purposes of reference only, and thus is not intended to be limiting. For example, terms such as "upper", "lower", "above", and "below" refer to directions in the drawings to which reference is made. Terms such as "left", "right", "front", "back", "rear", "bottom" and "side", describe the orientation of portions of the component within a consistent but arbitrary frame of reference which is made clear by reference to the text and the associated drawings describing the component under discussion. Such terminology may include the words specifically mentioned above, derivatives thereof, and words of similar import. Similarly, the terms "first", "second" and other such numerical terms referring to structures do not imply a sequence or order unless clearly indicated by the context.

When introducing elements or features of the present disclosure and the exemplary aspects, the articles "a", "an" and "the" are intended to mean that there are one or more of such elements or features. The terms "comprising", "including" and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

Although the description has been shown and described with respect to one or more embodiments, aspects, applications or implementations, it will occur to those skilled in the art based upon a reading and understanding of this description and the drawings that equivalent alterations and modifications may be made without detracting from the spirit and scope of the embodiments, aspects or implementations in the description. The description and claims are intended to include all such modifications and alterations.

What is claimed is:

1. An appliance lock comprising:

a housing attachable to one of an appliance body and a lid that is movable relative to the body between an open position and a closed position;

a first slider supported for movement by the housing;

a second slider supported for movement by the housing;

a striker attachable to the other of the appliance body and lid and connectable with housing upon movement of the lid to the closed position, the striker having a first portion for engaging and moving the first slider from a first position to a second, different position located along a moving path from the first position upon movement of the lid to the closed position, the striker having a second portion for engaging and moving the second slider from a first position to a second, different position located along the same moving path as the first slider from the first position upon movement of the lid to the closed position;

a switch assembly for electrical connection to a controller;

wherein the switch assembly interfaces with the first and second sliders when the first and second sliders being in the second position, providing indication that the lid is closed; and wherein the first and second sliders being in the second positions provides indication that the lid is closed; and structure to minimize the ability to simultaneously move the first and second sliders to the second position by substantially anything but the striker and thereby prevent activation of the appliance.

2. The appliance lock of claim 1 wherein the structure includes a separator attached to the housing and located between the sliders and wherein the first and second portions of the striker span the separator.

3. The appliance lock of claim 1 wherein the structure includes the sliders being spaced apart a predetermined distance and wherein the first and second portions of the striker span the predetermined distance.

4. The appliance lock of claim 1 further including a switch operatively connected to at least one of the first and second sliders to prevent activation of the appliance when the first and second sliders are in the first positions.

5. The appliance lock of claim 1 further including a third slider operably connected the first slider to move in unison with the first slider to the second position.

6. The appliance lock of claim 1 further including a mechanism to retain a slider in the second position and thereby blocking movement of the lid from the closed position when the appliance is activated.

7. The appliance lock of claim 1 wherein movement of the first and second sliders is reciprocally linear.

8. The appliance lock of claim 1 wherein the first portion of the striker engages only the first slider and the second portion of the striker engages only the second slider.

9. An appliance lock comprising:

a housing attachable to one of an appliance body and a lid that is movable relative to the body between an open position and a closed position;

a first slider supported for movement by the housing;

a second slider supported for movement by the housing;

a striker attachable to the other of the appliance body and lid and connectable with the housing upon movement to the lid to the closed position, the striker having a first portion for engaging and moving only the first slider from a first position to a second, different position located along a moving path from the first position upon movement of the lid to the closed position, the striker having a second portion for engaging and moving only the second slider from a first position to a second, different position located along the same moving path as the first slider from the first position upon movement of the lid to the closed position;

a switch assembly for electrical connection to a controller;

wherein the switch assembly interfaces with the first and second sliders when the first and second sliders being in the second position, providing indication that the lid is closed; and wherein the first and second sliders being in the second positions provides indication that the lid is closed; and a separator attached to the housing and located between the first and second sliders, the first and second portions of the striker span the separator, the separator minimizes the ability to simultaneously move the first and second sliders to the second position by substantially anything but the striker and thereby prevent activation of the appliance when the lid is not closed position.

10. The appliance lock of claim 9 further including a switch operatively connected to at least one of the first and second sliders to prevent actuation of the appliance when the first and second sliders are in the first positions.

11. The appliance lock of claim 10 further including a mechanism to retain a slider in the second position and thereby blocking movement of the lid from the closed position when the appliance is activated.

12. The appliance lock of claim 9 wherein the second slider is position within first slider.

13. The appliance lock of claim 9 wherein movement of the first and second sliders is reciprocally linear.

14. An appliance lock comprising:

a housing attachable to one of an appliance body and a lid that is movable relative to the body between an open position and a closed position;

a first slider supported for movement by the housing;

a second slider supported for movement relative to the housing in unison with the first slider;

a third slider supported for movement relative to the housing; and a striker attachable to the other of the appliance body and lid and operatively connectable with the housing upon movement to the lid to the closed position, the striker having a first portion for engaging and moving only the second slider from a first position to a second, different position located along a moving path from the first position upon movement of the lid to the closed position, the striker having a second portion for engaging and moving only the third slider from a first position to a second, different position located along the same moving path as the second slider from the first position upon movement of the lid to the closed position;

a switch assembly for electrical connection to a controller;

wherein the switch assembly interfaces with the first and third sliders when the first and third sliders being in the second position, providing indication that the lid is in closed position.

15. The appliance lock of claim 14 wherein the second and third sliders are spaced apart a predetermined distance, the first and second portions of the striker span the predetermined distance, the spaced apart sliders minimize the ability to move the second and third sliders to the second position by substantially anything but the striker and thereby prevent activation of the appliance when the lid is not in the closed position.

16. The appliance lock of claim 15 further including a separator and located between the second and third sliders, the first and second portions of the striker span the separator, the separator minimizes the ability to simultaneously move the second and third sliders to the second position by substantially anything but the striker and thereby prevent activation of the appliance when the lid is not closed position.

17. The appliance lock of claim 14 further including a switch operatively connected to at least one of the sliders the sliders to prevent activation of the appliance when the second and third sliders are in the first positions.

18. The appliance lock of claim 14 further including a mechanism to retain a slider in the second position and thereby blocking movement of the lid from the closed position when the appliance is activated.

19. The appliance lock of claim 18 further including a frangible connection between the first and second slider that breaks upon a predetermined force being applied to the lid to move the lid from its closed position.

20. The appliance lock of claim 14 wherein the second and third sliders are positioned within first slider.

* * * * *